US005392924A

United States Patent [19]

Hume

[11] Patent Number: 5,392,924

[45] Date of Patent: Feb. 28, 1995

[54] SAND WASHING

[75] Inventor: David H. Hume, Parkville, Australia

[73] Assignee: Little River Pastoral Co. Pty. Ltd., Victoria, Australia

[21] Appl. No.: 97,561

[22] Filed: Jul. 26, 1993

[30] Foreign Application Priority Data

Jul. 27, 1992 [AU] Australia ..... PL3776

[51] Int. Cl.[6] ..... B03D 1/02

[52] U.S. Cl. ..... 209/161; 209/173; 209/465; 210/221.2

[58] Field of Search ..... 209/159, 160, 161 I, 209/173, 465; 210/221.2, 703

[56] References Cited

U.S. PATENT DOCUMENTS

| | | | |
|---|---|---|---|
| 1,984,362 | 7/1931 | Dickson | 209/464 |
| 2,025,412 | 12/1935 | Handy | 209/161 |
| 3,043,430 | 7/1962 | Gish | 209/464 |
| 3,070,228 | 12/1962 | Hollingsworth | 209/160 |
| 3,152,979 | 10/1964 | Bichard et al. | 208/11 |
| 3,479,281 | 11/1969 | Kikindai et al. | 210/221.2 X |
| 3,525,437 | 8/1970 | Kaeding et al. | 210/221.2 X |
| 3,956,128 | 5/1976 | Turner | 210/221.2 X |
| 4,096,057 | 6/1978 | Porritt et al. | 209/161 X |
| 4,157,951 | 6/1979 | Park | 209/159 |
| 4,624,791 | 11/1986 | Ferriss | 210/221 X |
| 4,851,036 | 7/1989 | Anthes et al. | 209/159 X |

FOREIGN PATENT DOCUMENTS

| | | | |
|---|---|---|---|
| 29199/84 | 12/1985 | Australia . | |
| 4110026 | 10/1992 | Germany | 210/221.2 |
| 0087552 | 8/1978 | Japan | 210/703 |
| 1242187 | 9/1989 | Japan | 210/703 |
| 1445789A1 | 2/1987 | U.S.S.R. . | |
| 1577835A1 | 9/1988 | U.S.S.R. . | |
| 1555299 | 4/1990 | U.S.S.R. | 210/221.2 |

*Primary Examiner*—H. Grant Skaggs
*Assistant Examiner*—Carol L. Druzbick
*Attorney, Agent, or Firm*—Kinney & Lange

[57] ABSTRACT

There is disclosed a process and plant for cleaning unwashed clay/sand or oil sands in which a vessel having a false floor of permeable material contains a column of liquid and sand to be cleaned in which an air and liquid mix is injected through the permeable material at a controlled pressure so that the air, water and sand clay mixture will mix together to fluidise the sand with the presence of small bubbles of air to create a turbulence and abrasion of the particles and to clean the sand.

6 Claims, 1 Drawing Sheet

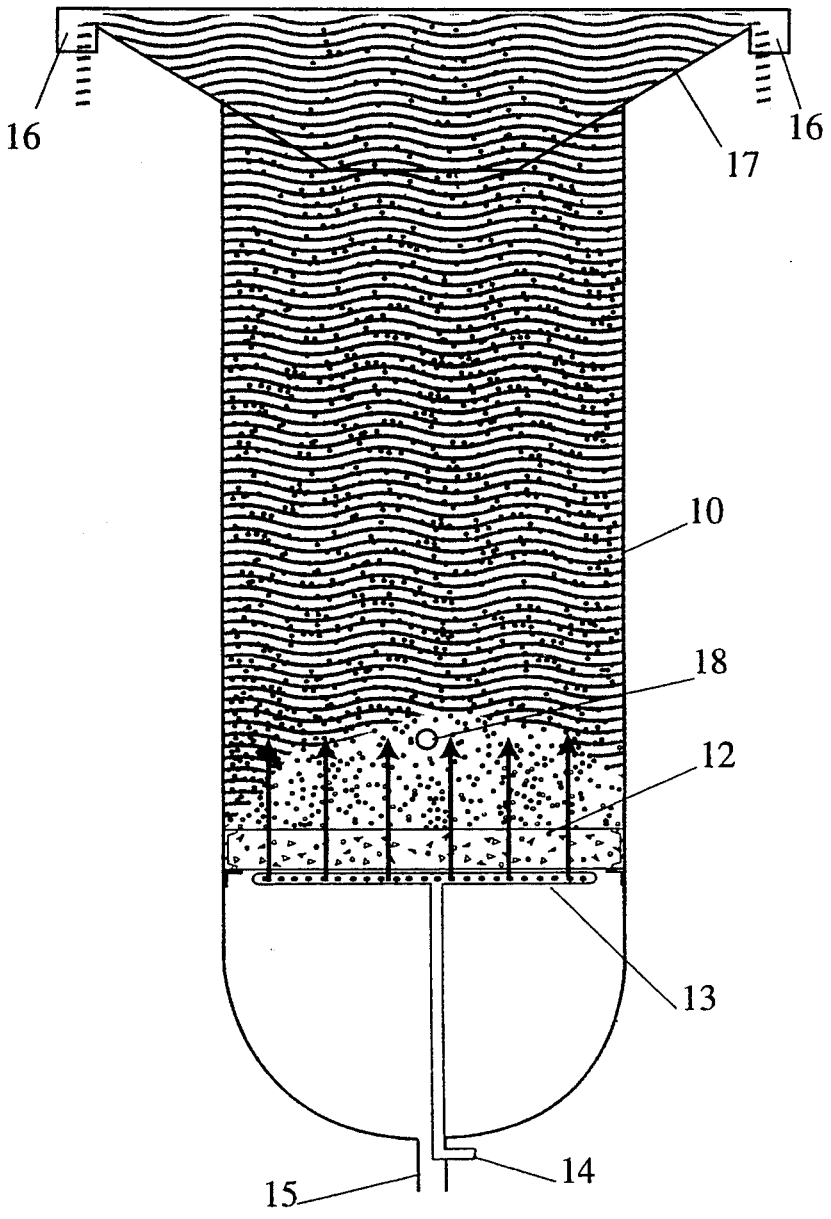
16
16
17
10
18
12
13
14
15

SAND WASHING

BACKGROUND OF THE INVENTION

1. Field of Invention

This invention relates to a plant and process for washing sand using low energy techniques.

2. Description of the Prior Art

Conventional sand washing techniques known to the applicant comprise relative movement of sand and liquid on a continuous basis acting to remove clay and other impurities from the sand. The sand particles are classified as to size by floating off fine particles from the washing container. Several cycles of cleaning may be required to remove all of the impurities and consequently horsepower and water consumption is high to maintain an effective process in such conventional techniques.

Naturally occurring deposits of sands contain clay and ultra-fine silica particles and the aim in conventional plants is to remove the so called "fines" ranging in size up to 75 microns, the fines include silica and clay particles and may also include liquids if in fact the deposits relate to oil sands. The process retains the coarser sand particles.

It is normal practice to wash sand in a continuous process, and it is usual to introduce sand/gravel and a clay mixture at the top of a washing tank and allow it to descend against a rising body of liquid, which takes the clay and fine silica into suspension before it is floated off over a weir at the top of the tank. If the sand is not clean by the time it has reached the bottom of the tank, it is usual to repeat the performance by pumping the sand and liquid to the top of a second tank, and so on until the desired state of cleanliness is achieved. Two, three and sometimes four such cycles may be required.

Other washing methods are used, for instance in ore classifiers as disclosed in U.S. Pat. No. 1,984,362, large diameter screws are fitted to inclined troughs, where water or like liquid and sand are added. The screws are rotated thus causing the sand to travel up the incline and be washed by the liquid being stirred with it. If it is not cleaned in the first pass, the process is repeated. A similar unit is disclosed in U.S. Pat. No. 3,043,430. Another method is to place high pressure water/sand nozzles opposed to each other in a tank as disclosed in Australian Patent No. 564412. The colliding liquid/sand streams cause the removal of contaminants from the silica such as clay and contaminant liquids. All of these methods utilise relatively high quantities of power. Another version noted is a hydro-deslimer as disclosed in U.S. Pat. No. 3,070,228 which provides a counterflow of water in a trough in which water is injected through small holes in the bottom of the trough.

Other methods of separation are disclosed for example in U.S. Pat. No. 3,152,979 relating to the separation of oil from tar sands in which water and air are introduced in a trough to assist in the separation of oil. The use of air in the assistance in separating sand particles is known and for example has been disclosed in Soviet Union specification Nos. 1445789 and 1577835.

It has been noted that there is a problem of washing of sand with a mixture of air and liquid since both the air and the liquid tend to take the line of least resistance through the matrix or pulp of sand clay thereby making tracks but-leaving areas of sand virtually untouched or unwashed. Thus with existing methods of air/liquid washing of sands inefficiencies are apparent which the present invention sets out to address.

SUMMARY OF THE INVENTION

The present invention has as its major objective the provision of a process and plant for treatment of quarried sand/gravel material which may contain clay or sand fines and other impurities including oil contaminants to be removed from the sand/gravel material in a simple and economical manner.

A further objective of the invention is to provide a batch sand washing process and plant in which the process and plant can be operated with little or no supervision during the washing cycle.

It is a further objective of the invention to provide apparatus for separating a liquid/fines admixture residue produced from the process and to minimise the amount of pollutants including polluted liquids as a result of the process.

There is provided according to the present invention a sand washing process comprising the steps of introducing the sand/gravel clay material to be washed into a vessel, filling the vessel with liquid, introducing at or near the bottom of the vessel liquid and air under pressure to create a flow of liquid and air towards the top of the vessel acting to agitate the material and thereby separate clay and other impurities from the material, wherein said air and liquid is substantially evenly distributed throughout the vessel so as to have a fluidising effect upon the liquid and material mixture and to separate the sand and impurities.

There is also provided according to the present invention a plant for performing the process including a vessel adapted to hold a column of liquid and sand/gravel clay material to be washed, means for supplying air and liquid under pressure to the vessel at or near the bottom thereof and including distribution means mounted at or near the bottom of the vessel for supporting the column of liquid and sand material and for receiving said air/liquid mixture and acting to substantially evenly distribute said air and liquid upon entry into the vessel through said distribution means.

The present invention is based upon the surprising discovery that even distribution of the liquid/air mix will result in more effective washing of the material thereby avoiding high power consumption requirements and unwashed or dead areas in the pulp matrix.

It is desirable that close control be maintained over the liquid/air mix relative to the static head of liquid in the vessel and the specific gravity of the sand/clay material being treated in the vessel.

Conveniently the distribution means constitutes a permeable material forming a false floor in the vessel covering substantially the entire area of the bottom of the vessel, the permeability of the material being such that the diameter of the air bubbles in the air/liquid mix is kept small thereby resulting in relatively even distribution of the air/liquid mix as it enters said vessel, this even distribution of small air bubbles contributing to the desirable fluidisation of the matrix and therefore efficient cleaning of the sand.

Preferably the permeable material is a cured concrete mix with fines removed or so called "no fines concrete". Other material such as ceramics, sintered bronze steel mesh, permeable plastic or permeable rubber may be used to form the permeable material for the false floor. It is desirable that the structural strength of the false floor is sufficient to contain and support the head of liquid and solids mix in the vessel.

The top of the vessel is formed as an over-flow weir to allow excess liquid and clay impurities and the like to spill over quietly from the vessel as liquid/air mix is injected through the permeable false floor.

It has been found that a vessel containing liquid may be filled with unwashed clay/sand or oil sand to a level of about 60% of its volume. If air and liquid are injected into the tank below the false floor at a controlled pressure, they will mix and rise together through the permeable material and in turn mix with the pulp mix. After a period of time the air and liquid will fluidise the sand, and because of the presence of air in small bubbles the specific gravity of the matrix will reduce. The rising air and liquid lift sand with them, and a point is reached where the mixture comes into imbalance and some of the sand then descends against the rising current. The condition causes an attritioning of the sand particles, where they rub against each other with an abrasive effect thus assisting the release of clay and fine silica from the outside of the coarser particles. This rising, overbalancing and falling of sand becomes one of the features of the washing cycle, and it occurs in random fashion.

Depending upon the particle size gradient of the matrix, and the relative volumes of air and liquid being injected, a state will be reached where the clay and the smaller sized silica particles will be kept in suspension in the liquid as it rises. Eventually, the liquid and these particles reach the weir and are floated off, leaving the cleaner and coarser sand in the tank. The process is continued until the desired degree of sand cleanliness has been reached.

In the method of the invention, the sand is held in the one container until it is cleaned to the desired state, and thus there is more flexibility than a plant which is laid out for a particular number of passes, also, liquid volume and therefore the horsepower demand in the inventive washing plant is considerably less than most other methods and the plant can be left unattended for long periods of time whilst the process continues.

A further feature of the system is concerned with the ability to empty the washing vessel. Normal washing tanks are built with conical bottoms so that the sand can be moved to the pump at the bottom of the tank. Some tanks are built with flat bottoms, but this is done to allow the sand moving vertically downwards to form its own cone on the bottom of the tank and thus not rub against the side of the tank to cause wear. The dead sand on the outside of the cone remains in position in the tank whilst providing the anti-wear function for which it is intended.

In the inventive process it has been found that the air/liquid tank can be built with a flat bottom, for the reason that the fluidisation of the sand in the tank will cause the sand to maintain a level condition as the tank empties and not a cone. Therefore, an outlet may be built in the centre of the tank, or at the outside wall to allow the pulp to flow to a pump.

In the injection of liquid and air through the distribution means, it is important that the pressure of liquid and air is controlled accurately; the pressure being sufficiently high to overcome the static head of the liquid in the vessel which is preferably formed as a tall column plus the added difference in specific gravity of the volume of sand that has been added to the vessel, whereby the degree of turbulence in the mixture is controlled in a balanced way.

The distribution means acts to ensure that the diameter of the air bubbles travelling therethrough and into the vessel are kept relatively small and of course it will be appreciated that this is controlled by the degree of permeability of the distribution means forming the false floor.

In a further aspect of the invention there is provided a bin for receiving clean sand pulp and liquid having a floor and/or wall formed from a permeable material such as no fines concrete, to act as a draining filter to separate liquid from the sand fines.

This aspect of the invention eliminates the necessity for utilising high power consumption hydrocyclones and the like to separate the liquid from the sand fines. The no fines concrete floor is easily cleaned in the event of blinding by back washing with air or liquid.

It will be appreciated that the process and apparatus may be applied to other mineral washing/separation operations including flocculation type separation processes and oil sand separation processes in which air/-liquid separation procedures are used and would be easily adapted to the inventive concept disclosed herein.

Thus the method and apparatus of the present invention is applicable to the treatment of oil sands or soil contaminated with soluble and insoluble liquids in which the air/liquid mix may be varied to a liquid plus additives/air mix or solvents/air mix given that relatively small quantities of liquid are called for by the use of this invention.

The relative volumes of air/liquid injection will determine the degree of turbulence and thus the size of the particles carried to the overflow weir and through the outlet. Low rates of overflow may take little or no fine particles with particle size increasing within increased turbulence and increased flows. Thus the plant can be used as a sizing device in which particle sizes up to a particular size may be removed from the plant by suitable control of the air/liquid volume.

BRIEF DESCRIPTION OF THE DRAWING

The invention will be described in greater detail having reference to the accompanying schematic drawing showing a sand washing plant according to the present invention.

DESCRIPTION OF THE PREFERRED EMBODIMENTS

The plant includes a tank 10 approximately 7.5 meters high and 2.8 meters in diameter adapted to be filled with a sand/gravel clay mix occupying at least 60% and up to approximately 70% of the space in the liquid filled column. As stated in the summary section, it is usual to introduce sand/gravel clay mixture and liquid through the top of the tank 10. The base 12 of the tank 10 is fitted with a no fines concrete block having a diameter and area matching the size of the tank 10. The base 12 admits an air/liquid mix which is injected through injector ports 14 and 15 at sufficient pressures to overcome the static head of liquid in the column and the weight of pulp to be cleaned. The top of the tank 10 is fitted with a weir 17 and liquid outlet 16 to take liquid overflow. Air is expelled through manifold 13 beneath the base 12.

In the example, the volume of water injected was 900 liters per minute at a pressure range of 100–200 kilo pascals and the volume of air injected was 1000 liters per minute at a pressure of 100–200 kilo pascals.

Assuming a static load of say 100 kilo pascals the pressure of liquid/air introduced into the vessel should be sufficient to overcome the static head and to generate a sufficient level of turbulence to achieve efficient separation of material and exhaustion of unwanted clay particles and other impurities including insoluble liquids but to retain the sand granules including at least some fines. Reference 18 is a pump pick-up point for removal of washed sand and liquid mix from the tank 10.

A sample of the feed in the plant was analysed giving the following analysis with sizes of particles given in microns with each of the columns referring to materials held at each stage:UNWASHED

| SIEVE | UNWASHED % RETAINED | WASHED % RETAINED | EFFLUENT % RETAINED |
|---|---|---|---|
| 1.18 mm | 1 | 1.23 | 0 |
| 600 μm | 1.4 | 1.72 | 0 |
| 425 μm | 2 | 2.45 | 0 |
| 300 μm | 19 | 23.32 | 0 |
| 212 μm | 30 | 36.82 | 0 |
| 150 μm | 19 | 23.32 | 0 |
| 106 μm | 4 | 4.91 | 0 |
| 75 μm | 2 | 2.36 | 0.40 |
| 53 μm | 2.4 | 2.58 | 1.62 |
| 38 μm | 2.4 | 1.29 | 7.29 |
| PAN | 16.8 | 0.00 | 90.69 |
| | 100% | 100% | 100% |

It will be noted that retention of washed sand granules in the important 150 micron to 300 micron range is excellent allowing for simple downstream separation in the system.

The analysis of the effluent indicates effective removal of clay and of some unwanted fine silica particles which can be closely controlled as mentioned previously by fine adjustment of the air/liquid pressure during the washing process for the reason that the effluent is a function of the amount of turbulence generated in the process.

In a further timed example using a small volume test rig (not shown) 35 liters of sand/gravel clay mix was added to a tank filled with water and treated with the air/water mix at a water injection rate of 120 liters per hour for one hour. The control sample contained 28% clay at the start of the test and 12% clay at the end of the test.

A similar test with a similarly sourced control sample containing 28% clay was treated with plain water washing in the same quantities namely 120 liters per hour. In this instance the pulp still contained 24% clay after one hour. In a further test with air mixing with water above the false floor the control sample contained 19% clay after one hour.

Thus for the addition of approximately 3.4 times the liquid to soil volume in the test rig there was a marked improvement in separation of clay and other unwanted contaminants from the soil sample as compared with the known prior art methods of plain water washing and uncontrolled air injection.

I claim:

1. A plant including a vessel having a bottom adapted to hold a column of liquid and sand/gravel and clay material to be washed, means for supplying air and liquid under pressure to the vessel adjacent the bottom of the vessel, the means including distribution means for receiving an air/liquid mixture, the distribution means acting to substantially evenly distribute the air throughout the column of liquid upon entry into the vessel through the distribution means, the distribution means being comprised of a permeable material forming a false floor in the vessel, the permeable material being constructed to allow travel therethrough of air and liquid into the column of liquid and sand/gravel and clay material to form air bubbles therein, the permeability of the permeable material being such that the diameter of the air bubbles in the air liquid mix is kept small thereby resulting in relatively even distribution of the air bubbles in the air/liquid mix as it enters and travels through the vessel.

2. A plant as claimed in claim 1 wherein the distribution means comprises permeable material which is a cured concrete mix with fines removed.

3. A plant as claimed in claim 1 wherein the permeable material is a diffuse ceramic material allowing the ingress of air therein.

4. A plant as claimed in claim 1 wherein the permeable material is a permeable plastic.

5. A plant as claimed in claim 1 wherein the permeable material is a permeable rubber.

6. A sand washing process utilizing the plant as defined in claim 1 wherein the distribution means is positioned adjacent the bottom of the vessel and air and additional liquid is introduced through the distribution means under pressure to create a flow of liquid and small air bubbles toward the top of the vessel acting to agitate the material and thereby separate clay and other impurities from the material, wherein the air bubbles are substantially evenly distributed throughout the liquid in the vessel so as to have a fluidizing effect upon the liquid and material mixture and separate the sand and the impurities.

* * * * *

UNITED STATES PATENT AND TRADEMARK OFFICE

CERTIFICATE OF CORRECTION

PATENT NO. : 5,392,924

DATED : February 28, 1995

INVENTOR(S) : DAVID H. HUME

It is certified that error appears in the above-indentified patent and that said Letters Patent is hereby corrected as shown below:

Col. 2, line 35, delete "sand/-", insert --sand/--

Col. 4, line 22, delete "air/-", insert --air/--

Signed and Sealed this

Eighteenth Day of July, 1995

*Attest:*

*Attesting Officer*

Bruce Lehman

BRUCE LEHMAN

*Commissioner of Patents and Trademarks*